United States Patent [19]

Garasimowicz et al.

[11] Patent Number: 5,001,431

[45] Date of Patent: Mar. 19, 1991

[54] CLIP FOR HOLDING IGNITION WIRES OF DIFFERENT SIZES

[75] Inventors: Gregory A. Garasimowicz, Mukwonago; Evan M. Eidsvoog, Waterford; Charles J. Yurkus, Milwaukee, all of Wis.

[73] Assignee: Bear Automotive Service Equipment Company, New Berlin, Wis.

[21] Appl. No.: 475,894

[22] Filed: Feb. 2, 1990

[51] Int. Cl.[5] ..... F02P 17/00

[52] U.S. Cl. ..... 324/402; 324/393; 439/175

[58] Field of Search ..... 324/402, 393, 391, 390, 324/72.5, 149; 439/166, 170, 171, 173–175, 169

[56] References Cited

U.S. PATENT DOCUMENTS

| | | | |
|---|---|---|---|
| 1,180,397 | 4/1916 | Hooker | 439/175 |
| 3,023,391 | 2/1962 | Pahl | 439/175 |
| 3,477,024 | 11/1969 | Pelta | 324/72.5 |
| 4,052,665 | 10/1977 | Gruenwald | 324/402 X |
| 4,853,625 | 8/1989 | Fodali et al. | 324/149 X |

*Primary Examiner*—Kenneth Wieder
*Assistant Examiner*—Jack B. Harvey
*Attorney, Agent, or Firm*—Kinney & Lange

[57] ABSTRACT

In an engine analyzer system, a test probe adapted for connecting to ignition wires of different diameters. The test probe including a pick-up clip for electrically coupling to the ignition wire and clamping to large diameter ignition wires. A rotatable clip adapted for clamping small size ignition wires is rotatable into alignment with the pick-up clip. The rotatable clip holds small diameter ignition wires in electrical contact with the pick-up clip.

13 Claims, 3 Drawing Sheets

CLIP FOR HOLDING IGNITION WIRES OF DIFFERENT SIZES

BACKGROUND OF THE INVENTION

The present invention relates to testing equipment for internal combustion engines. In particular, the present invention relates to a test probe clip adapted to clip on ignition wires.

As technology in the area of automotive systems has advanced, automotive test apparatus has followed and become increasingly more sophisticated. Present day automotive engine analyzer equipment requires many electrical connections to the engine under test. The connections are typically made with a pick-up or probe that clips onto an engine wire. The pick-ups use direct electrical contact along with capacitive and inductive coupling. For example, to measure battery voltage a direct electrical connection can be made to the automotive battery. In signals where AC components are present, the engine analyzer can be capacitively or inductively coupled to the signal through a test probe.

In an inductively coupled test probe, a testing coil is placed around a signal wire to be tested, an ignition wire for example The AC components present in the signal wire are inductively transferred to the testing coil The testing coil is connected to an amplifier for amplifying weak signals from the testing coil A capacitive test probe functions in a similar manner except that a capacitive probe uses a capacitor plate rather than an inductive coil as a signal pick-up. Signals from the capacitive test probe are amplified for use with the engine analyzer circuitry. In either case, electrical signals are provided which represent the AC components in the signal wire under test, without direct electrical connection to the engine wire.

In traditional ignition systems having a distributor and an ignition coil, the secondary voltage (which causes the spark plugs to fire) is sensed with a single high tension probe clamped over the secondary wire between the ignition coil and the center terminal of the distributor. In distributorless ignition system (DIS) on the other hand, there is no distributor and no single wire which carries the secondary voltage for all spark plugs. To sense secondary voltages in a DIS engine, an inductive or capacitive sensor must be connected over spark plug wires of the engine under test.

The probe clip used to connect the engine analyzer equipment to the spark plug wires of a DIS engine under test is of critical importance. If the clip does not remain in proper contact with the spark plug wires, the engine analyzer cannot provide accurate test results. A typical probe clip uses a resilient plastic material adapted to fit over the spark plug wire. The ignition wire is forced into the clip and the spring action of the clip material retains the wire. Unfortunately, spark plug wires vary in diameter. A probe clip adapted for a large diameter ignition wire cannot be securely clipped to a small diameter ignition wire. On the other hand, a probe clip adapted for a small diameter ignition wire tends to stretch out of shape when used with large diameter wires.

An inexpensive test probe clip for an engine analyzer system adapted for receiving both large and small diameter spark plug wires without being damaged would be a significant contribution to the art.

SUMMARY OF THE INVENTION

The present invention provides a test probe clip for connecting to an ignition wire (e.g. a spark plug wire) of an internal combustion engine. The present invention provides an inexpensive test probe clip adapted for receiving both large and small diameter ignition wires. The clip can securely grasp small diameter ignition wires and is not damaged by large diameter ignition wires.

In the present invention a capacitive test probe clip grips large diameter (typically 7–8 mm) ignition wires. The capacitive clip has two arms and is manufactured using a material having a memory, such as a nylon compound or other resilient plastic. When the ignition wire is pressed into the clip, the two arms are forced apart. When the ignition wire is placed fully in the clip, the arms of the clip tend to return to their original position and thereby grasp the ignition wire.

In accordance with the present invention, a pair of small clips is provided which are adapted to receive small diameter (typically 6.5–7 mm) ignition wires. These small clips are preferably made of a similar material and tend to return to their original shape after being deformed. When testing an engine having small diameter ignition wires, an operator aligns the small clips with the larger capacitive clip. The operator forces the small diameter ignition wire into the small clips. The arms of the small clips are forced open and grasp the ignition wire in a manner similar to the manner in which the capacitive clip grasps large diameter ignition wires as described above. The small clips secure the small diameter ignition wire in the capacitive clip so that the capacitive clip is electrically coupled to the ignition wire. Following measurement, the operator removes the ignition wire and moves the small clips out of alignment with the capacitive clip so that an engine with large diameter ignition wires may be tested.

In a preferred embodiment of the present invention. The pair of small clips are attached to a ring which is rotatable on the body of the test probe. By rotating the ring, the pair of small clips may be selectively rotated into and out of alignment with the capacitive clip.

DETAILED DESCRIPTION OF THE PREFERRED EMBODIMENTS

Figure 1:
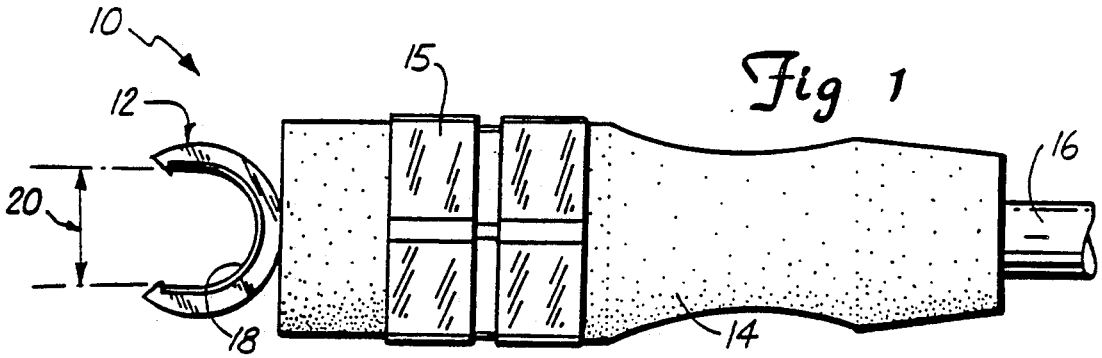
FIG. 1 is an elevational view of a capacitive probe clip.

The present invention provides an inexpensive test probe clip for use with an engine analyzer. The test probe clip is adapted to receive ignition wires with varying diameters. FIG. 1 shows a test probe 10 with a capacitive clip 12 and grip 14. Grip 14 forms a ridge 15.

A conductor 16 is electrically coupled through grip 14 to capacitive clip 12. Conductor 16 typically comprises a two conductor cable with a signal line and a ground. Capacitive clip 12 includes capacitive plate 18. Capacitive clip 12 has an inner diameter or span 20 which is sized to receive and hold the largest diameter ignition wire of interest. Clip 12 comprises a memory material such a nylon compound or other resilient plastic.

Figure 2:
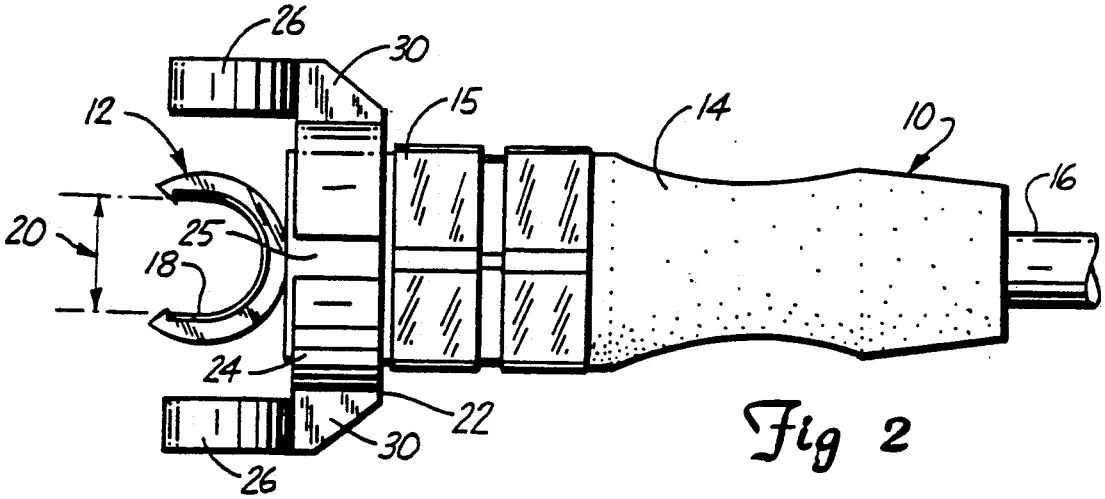
FIG. 2 is an elevational view of a capacitive probe clip including movable clips in accordance with the present invention.
Figure 3:
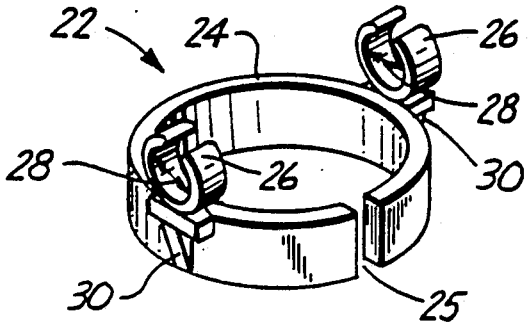
FIG. 3 is a perspective view of the movable clips shown in FIG. 2.

FIG. 2 shows test probe 10 including a movable clip 2 in accordance with the present invention. Movable clip 22 is rotatably mounted to grip 14 and is held in place between ridge 15 and capacitive clip 12. FIG. 3 shows a more detailed view of movable clip 22. Movable clip 22 includes ring 24 and clips 26. Clips 26 have an inner diameter or span 28 and are attached to ring 24 at brackets 30. Diameter 28 of clip 26 is smaller than diameter 20 of capacitive clip 12. Clips 26 comprise a memory material such as a nylon compound or other plastic.

In operation, ring 24 is rotatable about grip 14. Ring 24 is sandwiched between rib 15 and the edges of capacitive clip 12. Specifically, clips 26 on movable clip 22 may be aligned with clip 12 by rotating ring 24 about grip 14. When clips 26 are in alignment with capacitive clip 12, small diameter ignition wires may be held in clip 12. Test probe 10 can hold a large diameter ignition wire by rotating ring 24 so that clips 26 are not in alignment with clip 12. In this nonaligned position, clip 12 can hold large diameter ignition wires directly. Both capacitive clip 12 and clips 26 are formed using materials that have an elastic quality so that after the two arms of each clip are spread apart they tend to return to their original form. After an ignition wire is inserted into clips 26 or 12, the arms of the clip partially encircle the wire and thereby secure the wire in the clip.

Movable clip 22 is attached to grip 14 by elastic ring 24, which includes gap 25. Ring 24 has a slightly smaller inner diameter than the outer diameter of grip 14, so that when ring 24 is placed around grip 14, gap 25 allows the diameter of ring 24 to enlarge slightly. The elastic quality of the material used for ring 24 provides a clamping action on grip 14.

Figure 5:
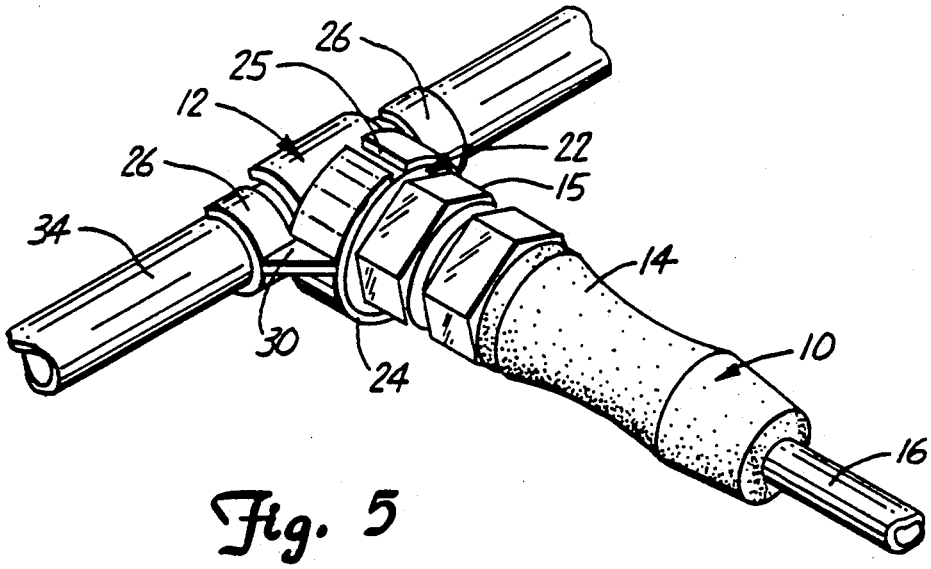
FIG. 5 is a perspective view of the probe clip of the present invention coupled to a small diameter ignition wire.
Figure 4:
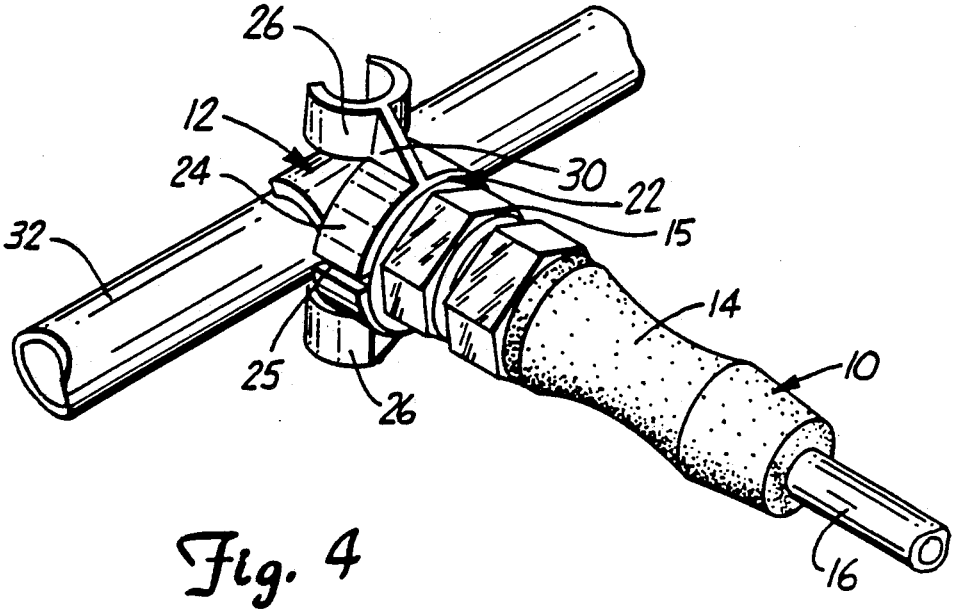
FIG. 4 is a perspective view of the probe clip of the present invention coupled to a large diameter ignition wire.

FIGS. 4 and 5 show test probe 10 operably coupled to a large diameter ignition wire 32 (FIG. 4) and small diameter ignition wire 34 (FIG. 5). In FIG. 4, clamp 22 is shown rotated about grip 14 in a nonaligned position so that clips 26 do not contact ignition wire 32. In this nonaligned position, the clamping action of capacitive clip !2 alone grips wire 32 to provide a good capacitive coupling between wire 32 and capacitive plate 18.

In FIG. 5, a small diameter ignition wire 34 is shown coupled to test probe 10. In FIG. 5, ring 24 of movable clip 22 is shown rotated so that clips 26 are in alignment with capacitive clip 12. Capacitive clip 12 does not directly clamp the small diameter ignition wire 34 because the diameter 20 of capacitive clip 12 is larger than the diameter of ignition wire 34. The inner diameters 28 of clips 26, however, are smaller than the diameter of ignition wire 34, so that clips 26 securely hold wire 34 in capacitive clip 12 for good capacitive coupling between wire 34 and capacitive plate 18.

Typically, a large diameter ignition wire 32 has a diameter ranging between about 7 mm and about 8 mm. A small diameter ignition wire 34 typically ranges in diameter from about 6.5 mm to about 7 mm. The inner diameters of clips 26 and capacitive clip 12 should be slightly smaller than the diameters of the ignition wires to ensure the wire is tightly held. Clips 26 should be formed in a material having an elastic memory so that they spring back to their original shapes after having clamped an ignition wire. A compound of about 10% to about 15% glass filled nylon is suitable for forming movable clip 22.

Figure 6:
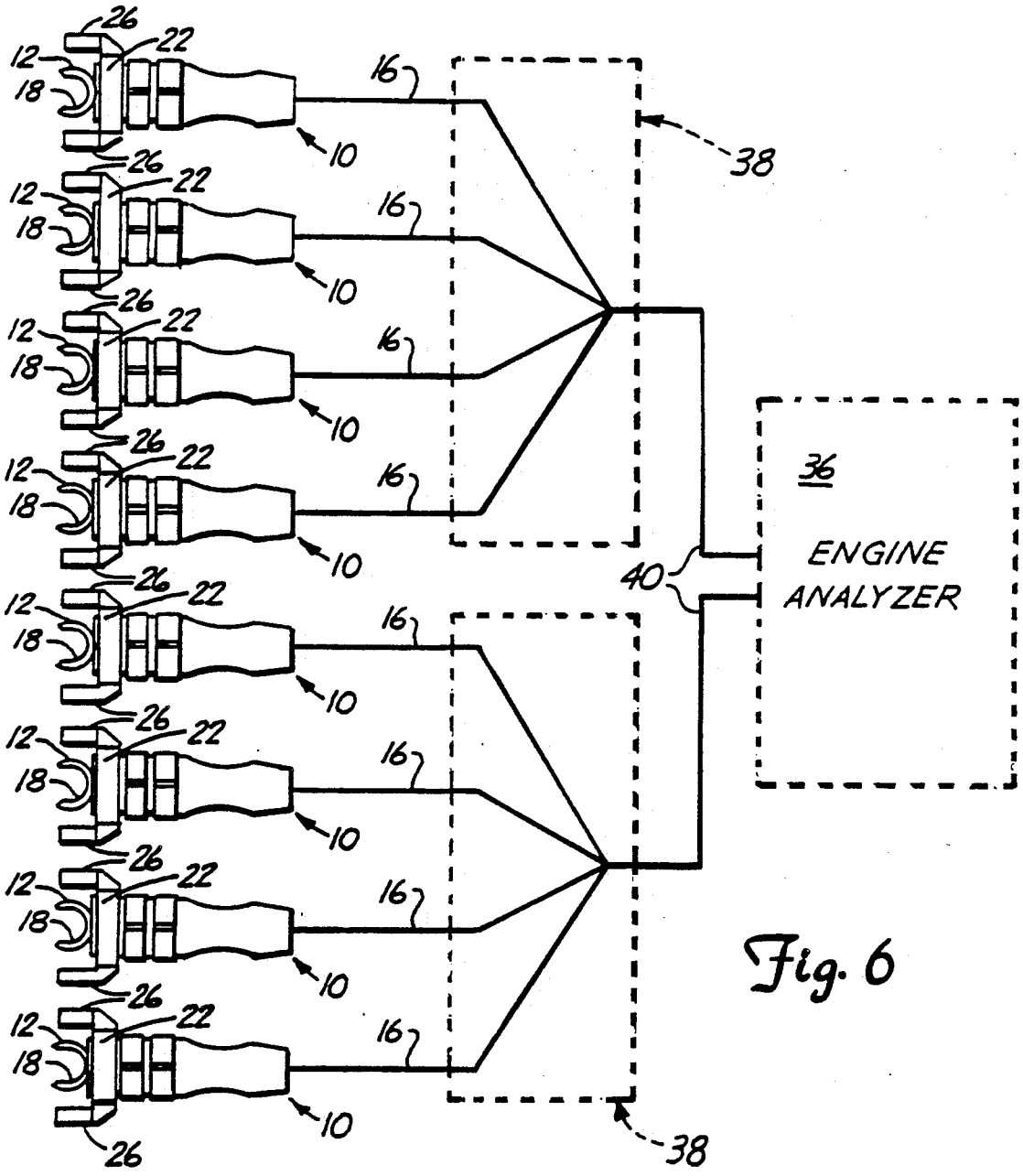
FIG. 6 shows an engine analyzer using test probe clips in accordance with the present invention.

FIG. 6 shows test probes 10 used with an engine analyzer 36. Two sets of four test probes 10 connect to junction boxes 38. Each junction box 38 connects to engine analyzer 36 through a conductor 40. Each test probe 10 may be coupled to a large or small size ignition wire as described above. Each junction box 38 combines the signals from each of the test probes into a single signal which is supplied as an input to the engine analyzer. Typically, one set of test probes 10 combined through a junction box 38 are connected to ignition wires having positive going spark pulses while the other set of probes 10 are connected to ignition wires having negative-going spark pulses.

The present invention provides inexpensive test probe clips adapted for receiving both large and small diameter ignition wires in an internal combustion engine analyzer. By providing two clip sizes, one for large diameter ignition wires and one for small, the clips of the present invention are not damaged when a large diameter wire is probed. When the small size clips are brought into alignment with the capacitive clip, small diameter ignition wires are securely coupled with the capacitive plate of the capacitive probe.

Although the present invention has been described with reference to preferred embodiments, workers skilled in the art will recognize that changes may be made in form and detail without departing from the spirit and scope of the invention. For example, the movable clip can be brought into alignment using techniques other than rotating; the clips can be adapted for different sized ignition wires, additional clips can be provided so that the test probe can accept more than two general sizes of wire; and test probe pick-ups other than capacitive pick-ups can be used with the present invention.

What is claimed is:

1. A test probe for an engine analyzer for coupling to an ignition wire of an internal combustion engine comprising:

a pick-up adapted for receiving a first diameter ignition wire; and means adapted for receiving a second, smaller diameter ignition wire wherein the means adapted for receiving a second diameter ignition wire is movable, relative to the pick-up, between a first storage position and a second holding position in which the means adapted for receiving a second diameter ignition wire is in alignment with the pick-up.

2. The test probe of claim 1 wherein the pick-up includes a grip portion, and wherein the means adapted for receiving a second diameter ignition wire is rotatable about the grip portion between the first and second positions.

3. The test probe of claim 1 wherein the pick-up comprises a capacitive pick-up.

4. The test probe of claim 2 wherein the means adapted for receiving a second diameter ignition wire comprises a slidable ring.

5. The test probe of claim 4 wherein the pick-up includes a clamp having a first inner dimension and the slidable ring includes a clamp having a second inner dimension.

6. The test probe of claim 5 wherein the first inner dimension is larger than the second inner dimension.

7. The test probe of claim 5 wherein the clamp comprises a material having a shape memory.

8. The test probe of claim 7 wherein the clamp comprises nylon compound.

9. A method of coupling a test probe in an internal combustion engine analyzer to an ignition wire in an internal combustion engine comprising:

aligning a first clip with a wire-receiving channel of a pick-up on the test probe, the channel having ends and wherein the first clip is longitudinally spaced from the ends of the channel; and inserting the ignition wire into the first clip and the channel whereby the ignition wire is held by the clip in the channel and is electrically coupled to the pick-up.

10. The method of claim 9 wherein aligning the clip comprises rotating a ring about the test probe.

11. The method of claim 9 wherein the pick-up comprises a capacitive pick-up.

12. The method of claim 9 wherein the pick-up comprises a second clip which defines the wire-receiving channel.

13. The method of claim 12 wherein the first clip is adapted for receiving an ignition wire having a first diameter and the second clip is adapted for receiving an ignition wire having a second larger diameter.

* * * * *